US009852853B2

(12) United States Patent
Armendariz

(10) Patent No.: US 9,852,853 B2
(45) Date of Patent: Dec. 26, 2017

(54) THERMALLY FUSED SPACERS

(71) Applicant: Hewlett-Packard Development Company, L.P., Houston, TX (US)

(72) Inventor: Luis C. Armendariz, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 174 days.

(21) Appl. No.: 14/882,964

(22) Filed: Oct. 14, 2015

(65) Prior Publication Data

US 2017/0110269 A1 Apr. 20, 2017

(51) Int. Cl.
*H01H 13/703* (2006.01)
*H01H 13/7065* (2006.01)
*H01H 13/88* (2006.01)

(52) U.S. Cl.
CPC ..... *H01H 13/703* (2013.01); *H01H 13/7065* (2013.01); *H01H 13/88* (2013.01); *H01H 2211/00* (2013.01); *H01H 2227/036* (2013.01); *H01H 2229/024* (2013.01)

(58) Field of Classification Search
CPC .. H01H 13/703; H01H 13/7065; H01H 13/88; H01H 2211/00; H01H 2227/036; H01H 2229/024; H05K 3/28
USPC ..... 200/5 A, 304–305, 310–314, 512–514, 200/516
See application file for complete search history.

(56) References Cited

U.S. PATENT DOCUMENTS 5,152,392 A * 10/1992 Iwasa ..... H01H 13/705 200/329
5,664,667 A 9/1997 Kenmochi
5,727,310 A * 3/1998 Casson ..... H05K 3/323 29/830
5,748,114 A * 5/1998 Koehn ..... G06F 3/0202 200/5 A
8,890,014 B1 * 11/2014 Chen ..... G02B 6/0036 200/310
2014/0138231 A1 5/2014 Chen

FOREIGN PATENT DOCUMENTS

DE 3624666 A1 12/1986
JP 2000100277 A 4/2000

OTHER PUBLICATIONS

"Manufacturing for Custom Electronic Membrane Switches & Keyboards", Oct 13, 2012.

* cited by examiner

*Primary Examiner* — Edwin A. Leon
(74) *Attorney, Agent, or Firm* — Brooks, Cameron & Huebsch, PLLC

(57) ABSTRACT

Example implementations relate to thermally fused spacers. In one example, keyboard membranes including thermally fused spacers include a first circuit including a first conductive trace and a first key contact of the keyboard membrane, where the first conductive trace is coupled to the first key contact, a second circuit including a second conductive trace and a second key contact of the keyboard membrane, where the second conductive trace is coupled to the second key contact, and wherein the second key contact is to couple to the first key contact, and a spacer formed of a layer of thermoplastic material, a first thermoplastic film, and a second thermoplastic film, where the spacer is fused via the first thermoplastic film to the first circuit and via the second thermoplastic film to the second circuit.

15 Claims, 4 Drawing Sheets

THERMALLY FUSED SPACERS

BACKGROUND

Keyboards are utilized in a variety of applications. For example, keyboards may be utilized as an input device to provide letters, numbers and/or characters to a computer, among other possibilities. Ensuring that a keyboard operates as intended may be desirable.

DETAILED DESCRIPTION

Figure 1:
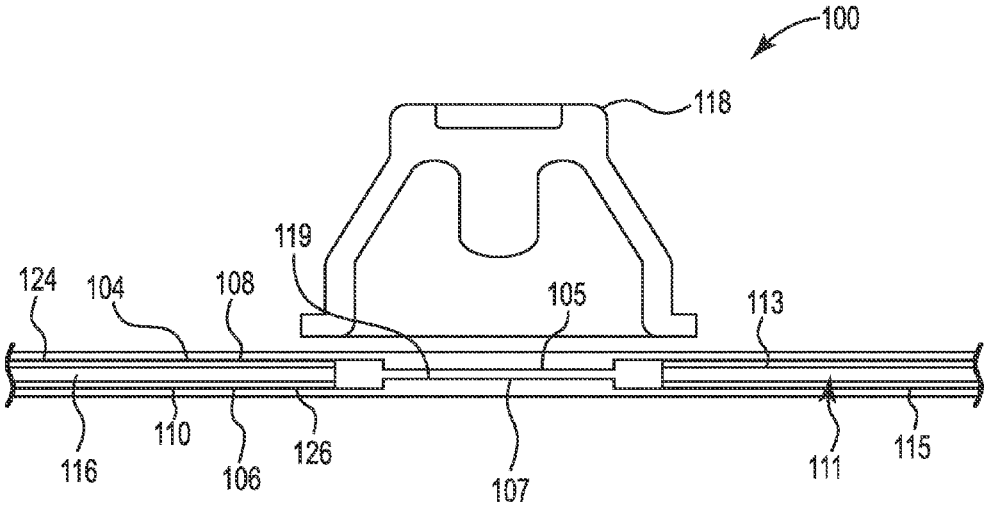
FIG. 1 illustrates a profile view of an example of a keyboard membrane including a thermally fused spacer according to the disclosure.

During an operational lifetime a keyboard may be subjected to environmental conditions such as humidity and/or liquid (e.g., liquids spilled on a surface of the keyboard), among other environmental conditions, that may cause the keyboard to experience temporary and/or permanent damage. As a result, the keyboard may not function as intended. For example, a particular key (e.g., a spacebar) on the keyboard may not produce a desired output (e.g., a space). As such, ensuring that a keyboard operates as intended may be desirable.

Examples of the disclosure include keyboard membranes including thermally fused spacers and methods of manufacturing the same. Keyboard membranes as used herein refer to those suitable in a keyboard. As used herein, sealed conductive traces refer a conductive trace (e.g., a silver conductive trace) coupled to contact (e.g., a key contact) included in a circuit such as a circuit included in a keyboard membrane where the conductive trace is at least partially sealed from environmental conditions such as humidity and/or liquids, among other environmental conditions by a layer of thermoplastic material. That is, while described herein with respect to keyboard membranes, thermally fused spacers can be utilized a variety of other applications and/or devices that employ a conductive trace or similar electrical component.

A keyboard membrane including a thermally fused spacer can, for example, include a first circuit including a first conductive trace and a first key contact of the keyboard membrane, where the first conductive trace is coupled to the key contact, a second circuit including a second conductive trace and a second key contact of the keyboard membrane, where the second conductive trace is coupled to the second key contact, and where the second key contact is to couple to the first key contact, and a spacer formed of a layer of thermoplastic material, a first thermoplastic film, and a second thermoplastic film, where the spacer is fused via the first thermoplastic film and the second thermoplastic film to the first circuit and the second circuit.

Desirably, keyboard membranes including thermally fused spacers, as described herein, provide protection from environmental conditions such as humidity and/or liquids while retaining desired functionality of the keyboard membrane (e.g., having a desired force to fire, etc.), in contrast to other keyboard membranes such as those that do not include thermally fused spacers and/or employ printed adhesives and/or solvent based adhesives within a keyboard membrane and therefore may not function as intended during and/or following being exposed to various environmental conditions such as exposure of the keyboard membrane to humidity and/or liquids. That is, the disclosure eliminates use of adhesives such as printed adhesive and/or solvent based adhesives, etc., within a keyboard membrane and instead circuits off a keyboard membrane are separated by a spacer formed of a layer of thermoplastic material, a first thermoplastic film, and a second thermoplastic film, where the spacer is fused via the first thermoplastic film and the second thermoplastic film to the first circuit and the second circuit (i.e., fused without intervening elements such as printed adhesives, solvent based adhesives, or mechanical fasteners) to the circuits to non-removably couple the first circuit and the second circuit to the spacer and thereby create a seal from an environment external to the keyboard membrane.

FIG. 1 illustrates a profile view of an example of a keyboard membrane including a thermally fused spacer according to the disclosure. The keyboard membrane 100 includes a first circuit 104 having a first face 108, a second circuit 106 having a second face 100, and a spacer 111 formed of thermoplastic material 116, a first thermoplastic film 113, and a second thermoplastic film 115. However, while FIG. 1 illustrates the keyboard membrane as including a particular number of elements, the present disclosure is not so limited. Rather, elements shown in the various figures herein can be added, exchanged, and/or eliminated so as to promote various aspects of thermally fused spacers according to the disclosure. For example, while not illustrated as such in FIG. 1, the keyboard membrane 100 can include a vent, as described herein. As mentioned, keyboard membranes herein such as keyboard membrane 100 employ thermally fused spacers and are free of adhesives such as printed adhesives and/or solvent based adhesives in contrast to other approaches that may employ printed and/or solvent based adhesives, among other types of adhesives, in an effort to couple a material (e.g., polyethylene terephthalate) to an internal of a circuit. That is, keyboard membranes herein are free of printed adhesive and solvent adhesive at least between the first circuit 104 and the second circuit 106.

The first circuit 104 can include a first conductive trace (not shown for ease of illustration in FIG. 1) and a first key contact 105. The first conductive trace is coupled to the key contact 105. The second circuit 106 can include a second conductive trace (not shown for ease of illustration) and a second key contact 107. The second conductive trace is coupled to the second key contact 107.

The conductive traces, in some examples, are silver conductive traces. That is, the first conductive trace can be silver conductive trace and/or the second conductive trace can be a silver conductive trace. However, the present disclosure is not so limited. Rather, the conductive traces can be formed of a variety of suitable materials including silver and carbon and/or combinations thereof, among other types of suitable materials.

The second key contact 107 is to contact the first key contact 105, for example, when the first key contact 105 of the first circuit 104 is displaced by a displacement force applied to a key 118 coupled to the first key contact 105, among other possibilities to contact the first key contact 105 and the second key contact 107. For instance, the first key contact 105 may be displaced along a path of travel that is substantially perpendicular to the first circuit 104 and/or the second circuit 106. Contact between the first key contact 105 and the second key contract 107 can include causing the first key contact 105 to move along the path of travel to be positioned adjacent to and/or substantially adjacent to the second key contact 107 to couple (e.g., electrically couple) the first key contact 105 with the second key contract 107.

As illustrated in FIG. 1, the keyboard membrane 100 can include a spacer 111 formed of thermoplastic material 116, the first thermoplastic film 113, and the second thermoplastic film 115. The spacer 111 can be disposed between the first circuit 104 and the second circuit 106 to provide a distance separating the first circuit 104 from the second circuit 106 (e.g., separating the first circuit 104 from the second circuit 106 absent a displacement force applied to the first circuit). That is, the spacer 111 can promote various performance characteristics, for example, disposition of the first circuit 104 and the second circuit 106 to have a desired force to fire (i.e., an amount of force applied to the keyboard membrane 100 sufficient to complete a switch formed between the first key contract 105 and the second key contract 107.

As illustrated in FIG. 1, spacer 111 is formed of the first thermoplastic film 113, the second thermoplastic film 115, and the layer of thermoplastic material 116. In various examples, the first thermoplastic film 113 is disposed on a first face 124 of the layer of thermoplastic material 116 and the second thermoplastic film 115 is disposed on a second face 126 of the layer of thermoplastic material 116 to form the spacer 111, as described herein.

The first thermoplastic film 113 and the second thermoplastic film 115 refer to thermoplastic films that have suitable glass transition temperatures and/or melting points for thermally fused spacers, as described herein, and can be activated by heat and/or pressure to fuse together elements without use of solvents and/or without use of printed adhesives. Examples of suitable films include polyester based films, polyurethane based films, and/or combinations thereof, among other suitable thermoplastic films that can be activated by heat and/or pressure to fuse together elements without use of solvents (i.e., do not include solvents) and/or without use of printed adhesives. The first thermoplastic film 113 and the second thermoplastic film 115 can have respective glass transition temperatures and respective melting points comparatively lower than a melting point of a various other materials included in a keyboard membrane such as the thermoplastic material, a first circuit and/or a second circuit included in a keyboard membrane.

The thermoplastic material 116 refers to a thermoplastic material such as polyethylene terephthalate, among others thermoplastic materials having a suitable glass transition temperature and/or suitable melting point above glass transition temperatures and/or melting temperatures of the first thermoplastic film and the second thermoplastic film, as described herein, to promote thermally fused spacers. For example, the thermoplastic material 116 can have a glass transition temperature that is comparatively higher than a glass transition temperature of the first thermoplastic film 113 and/or a glass transition temperature the second thermoplastic film 115. Similarly, the thermoplastic material 116 can have a melting point that is comparatively higher than a melting point of the first thermoplastic film 113 and/or a melting point the second thermoplastic film 115. For instance, in some examples, the thermoplastic material 116 can have a melting point that is comparatively higher than a melting points of each of the first thermoplastic film 113 and the second thermoplastic film 115

Figure 2:
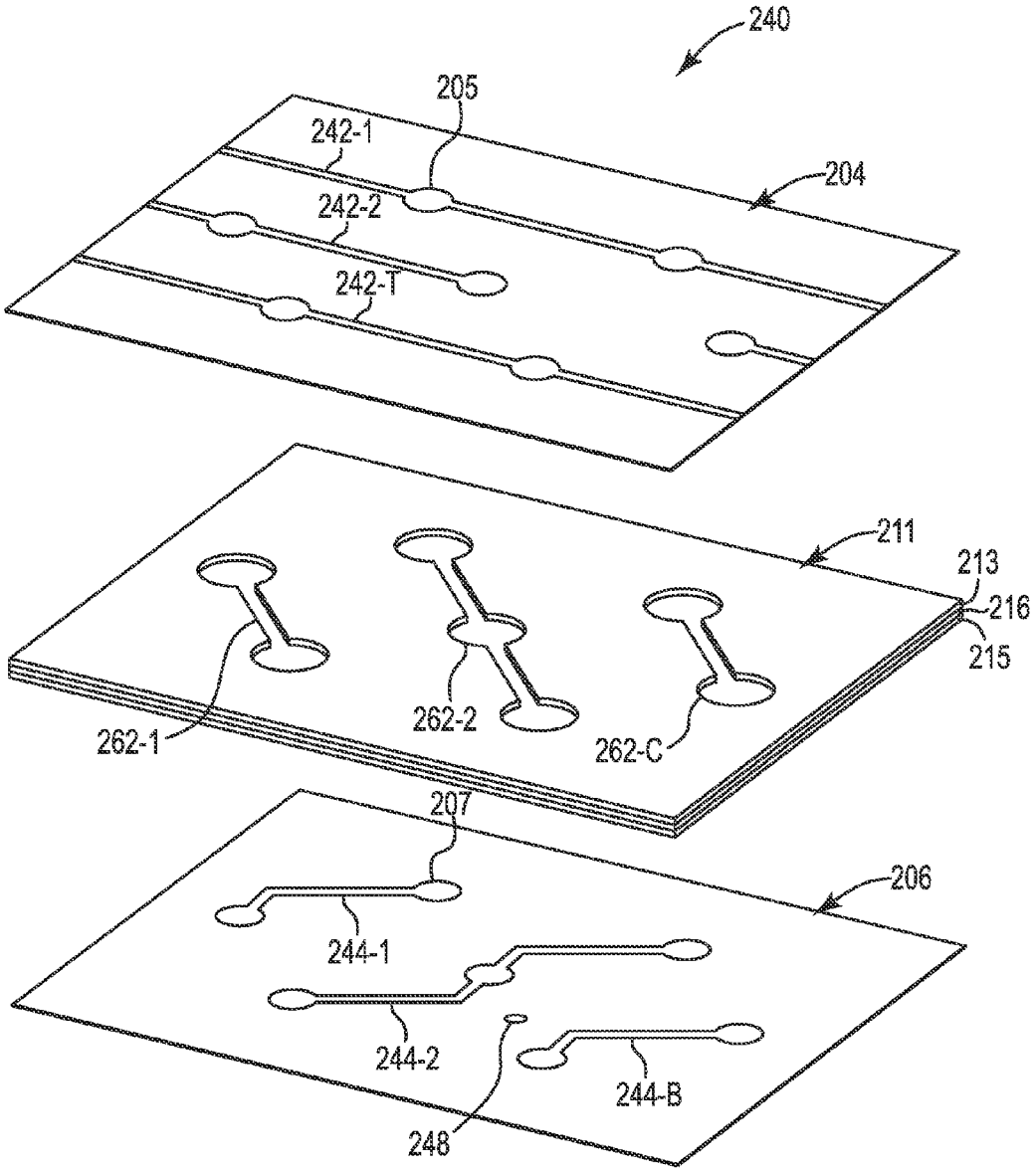
FIG. 2 illustrates an exploded view of an example of a keyboard membrane including a thermally fused spacer according to the disclosure.

In various examples, the spacer 111 overlays a portion of each of a first conductive trace and a second conductive trace to seal the first conductive trace and the second conductive trace, as described herein in greater detail with respect to FIG. 2. Put another way, the spacer 111 can include continuous layer of thermoplastic material that overlays both of a portion of the first conductive trace a portion of the second conductive trace. In some examples, the layer of thermoplastic material 116 of the spacer 111 overlays an entire length of at least one of the first conductive trace and the second conductive trace.

The spacer 111 can be from 10 microns to 1000 microns thick. All individual values and subranges from 10 microns to 1000 microns of thickness are included; for example, the thickness of the spacer 111 can be from a lower limit of 10 microns, 15 microns, 25, or 50 microns to an upper limit of 1000 microns, 900 microns, or 600 microns of thickness seal the first conductive trace and the second conductive trace. For example, the spacer 111 can have a particular thickness extending substantially perpendicular from a first face 108 of the first circuit 104 to a second face 110 of the second circuit 105.

Put another way, the thickness of the spacer is equal to a total number of microns of thermoplastic material and thermoplastic material that form the spacer 111 and extend from the first face 108 of the first circuit 104 to the second face 110 of the second circuit 105. In various examples, the first circuit 104 and the second circuit 105 can be co-planar at least with respect to their internal faces opposed to each other. For example, the first face 108 and the second face 110 can be co-planar as illustrated in FIG. 1.

The keyboard membrane 100 includes an opening 119 to permit the first key contact 105 to contact the second key contact 107. For example, the opening 119 can extend from the first key contact 105 of the first circuit 104 to the second key contract 107 of the second circuit 106 through the spacer 111, as illustrated in FIG. 1.

Such an opening can extend through cutouts included in a spacer, as described herein, to promote desired performance characteristics of a keyboard membrane including promoting a desired force to collapse the dome 118 (e.g., the desired force can be equal and/or in excess of a predetermined amount of force to collapse the dome 118) and/or a desired force to fire (e.g., the desired force to fire equal and/or in excess of a predetermined amount of force to fire), among other performance characteristics. Notably, at least of portion of the opening 119 extends through cutouts in the spacer 111 (i.e., through cutouts included in a layer of thermoplastic material 116 and through the first and second thermoplastic films forming the spacer 111) from the first key contact 105 to the second key contact 106. For instance, at least a portion of the opening 119 extends from the first key contact 105 of the first circuit 104 to the second key contact 107 of the second circuit 106 to provide a potential for contact of the first key contact 105 with the second key contact 107 in response to a displacement force applied to the keyboard membrane 100, as illustrated in FIG. 1.

FIG. 2 illustrates an exploded view of an example of a keyboard membrane 240 including a thermally fused spacer according to the disclosure. As mentioned, the keyboard membrane 240 includes a first circuit 204, a second circuit 206, and a spacer 211. The keyboard membrane 240 is analogous to keyboard membranes 100 and 380 referenced by FIG. 1 and FIG. 3, respectively.

The keyboard membrane 240 can include a vent 248. Vent refers to an orifice extending through the first circuit 204 and/or the second circuit 206. That is, while the vent 248 is illustrated as extending through an entire thickness of the second circuit 206 as illustrated in FIG. 2, the disclosure is not so limited. Rather, a location and/or a total number of vents included in the first circuit 204 and/or the second circuit 206 can be varied to vent the keyboard membrane 240 (e.g., to ensure intended movement of the key contacts) and/or otherwise promote thermally fused spacers.

As illustrated in FIG. 2, the keyboard membrane 240 can include a plurality of conductive traces 242-1, 242-2, . . . , 242-T and/or 244-1, 244-2, . . . , 244-B. However, while three conductive traces 242-1, 242-2, . . . , 242-T are illustrated on the first circuit 204 and three conductive traces 244-1, 244-2, . . . , 244-B are illustrated on the second circuit 206 the disclosure is not so limited. A total number, orientation, and/or a location of conductive traces and/or keycaps can be varied to promote thermally fused spacers.

As illustrated, the keyboard membrane 240 can include a plurality of keycaps coupled to the plurality of conductive traces. For example, a first key contact 205 is coupled to a first conductive trace. Similarly, a second key contact 207 is coupled to a second conductive trace 244-1.

As mentioned, the spacer 211 is formed of a first thermoplastic film 213, a second thermoplastic film 215, and a layer of thermoplastic material 216. The spacer 211 can include a plurality of cutouts 262-1, 262-2, . . . , 262-C. It is noted that keycaps, key mechanisms, and domes of the keycaps have been omitted from FIG. 2 and FIG. 3 for ease of illustration. As illustrated, the cutouts 262-1, . . . , 262-C extend through the spacer 211. The plurality of cutouts 262-1, . . . , 262-C (e.g., each of plurality of cutouts) can be coupled to an opening in the keyboard membrane 260 described with respect to FIG. 1. For example, the plurality of cutouts 262-1, . . . , 262-C can permit a key (e.g., key 118 as described with respect to FIG. 1) to travel through the plurality of cutouts. For instance, the plurality of cutouts 262-1, . . . , 262-C can permit a key to travel through the cutouts and/or into a portion of a volume of the space in the keyboard membrane, as described herein. While FIG. 2 illustrates three cutouts 262-1, 262-2, . . . , 262-C having particular shapes and orientations the present disclosure is not so limited. That is, a total number, location, and/or shape, among other aspects of the plurality of cutouts 262-1, . . . , 262-C can be varied to promote thermally fused spacers.

Figure 3:
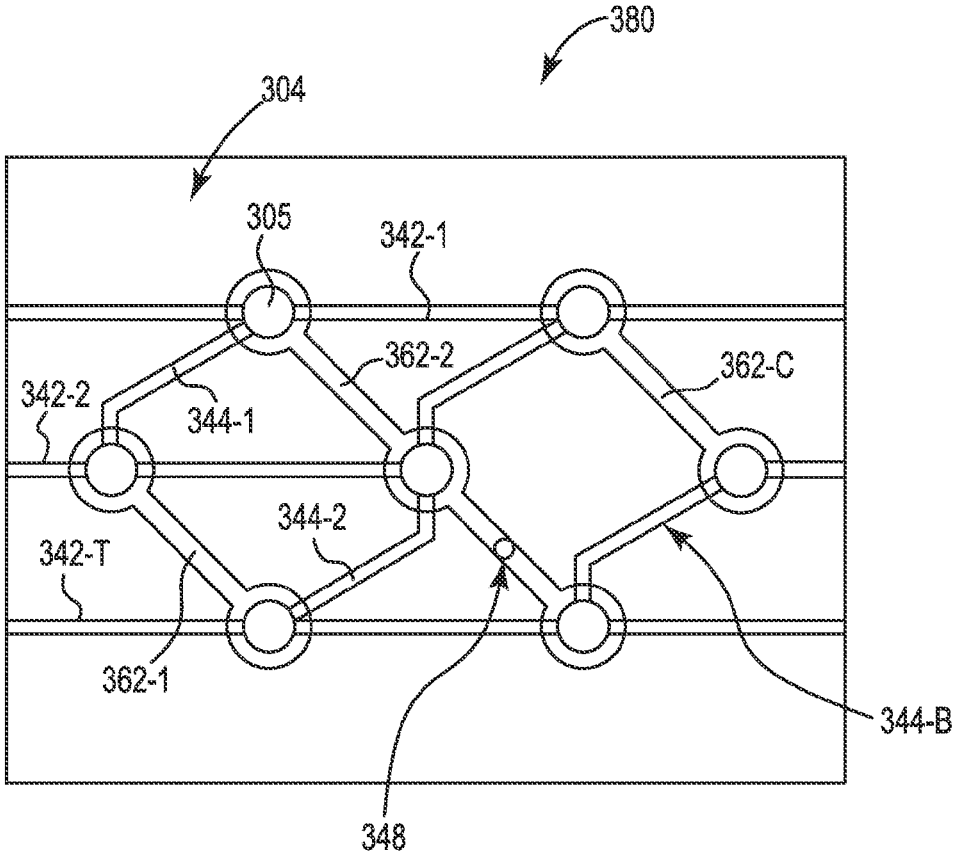
FIG. 3 illustrates a top view of an example of a keyboard membrane including a thermally fused spacer according to the disclosure.

It is noted that the 262-1, 262-2, . . . , 262-C are formed in a manner such that each of the cutouts interconnects a plurality of key contacts such as cutout 262-1 the interconnects two key contacts Similarly, cutout 262-2 interconnects three key contacts. Having the cutouts 262-1, 262-2, . . . , 262-C each interconnect a plurality of key contacts can promote venting of the keyboard membrane, which can be particularly evident when a cutout such as cutout 262-2 interconnects a plurality of key contacts and at least one vent such as vent 248 that is overlapped by the cutout 262-2 and thereby the vent 248 is interconnected via the cutout 262-2 with three key contacts, as is illustrated in FIG. 2 and FIG. 3. That is, in some examples, the spacer includes cutouts in communication with at least one vent.

FIG. 3 illustrates a top view of an example of a keyboard membrane 380 including a thermally fused spacer according to the disclosure. Keycaps, key mechanisms, domes of the keycaps, and electrical bridges have been omitted from FIG. 3 for ease of illustration. For descriptive purposes elements such as cutouts and conductive traces of a second circuit are illustrated in FIG. 3 although such elements may ordinarily be obstructed from the top view of the keyboard membrane 380.

As illustrated in FIG. 3, the keyboard membrane 380 includes a first circuit including conductive traces 342-1, 342-2, . . . 342-T, a spacer (not shown for ease of illustration) formed of thermoplastic material including cutouts 362-1, 362-2, . . . , 362-C, a second circuit (not show for ease of illustration) including conductive traces 364-1, 364-2, . . . , 364-B, and vent 348. The conductive traces 342-1, . . . , 342-T and 364-1, . . . , 364-B can be coupled to key contacts. For example, a first conductive trace 342-1 is coupled to a first key contact 305, as illustrated in FIG. 3.

Figure 4:
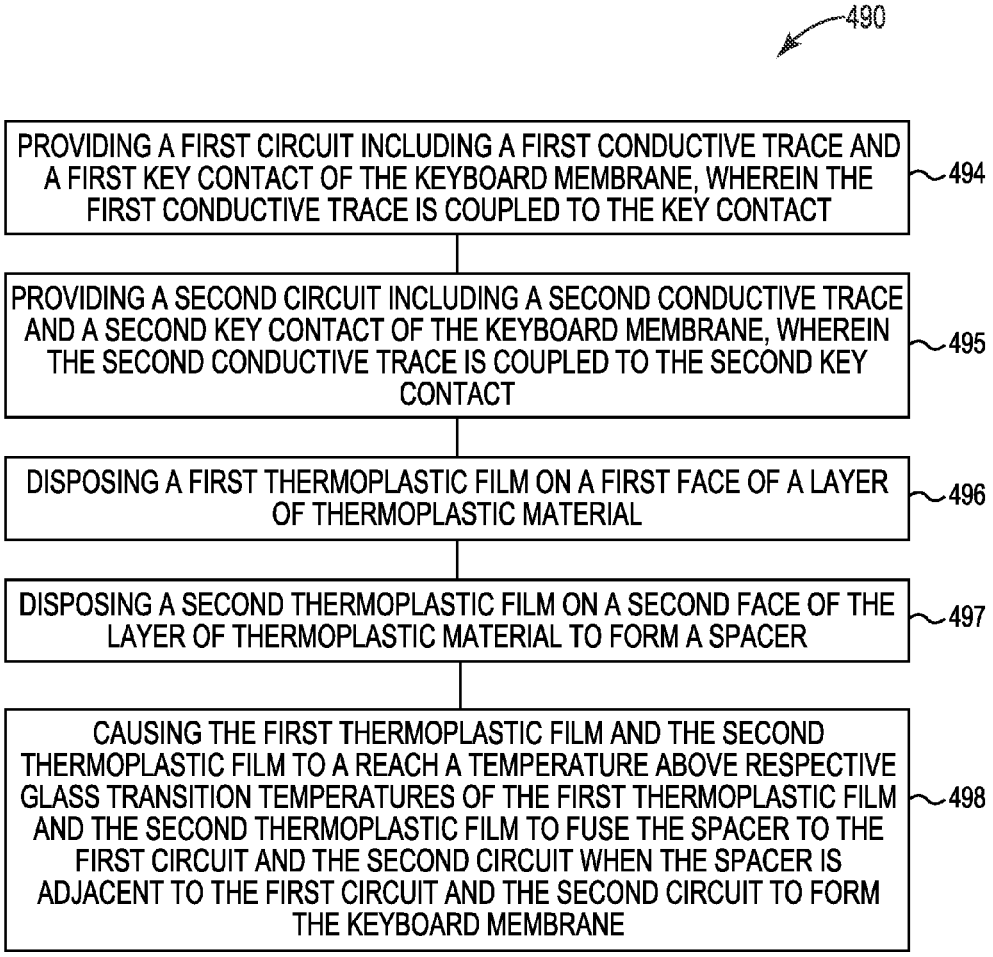
FIG. 4 illustrates a flow diagram of an example of a method of manufacture of keyboard membranes including a thermally fused spacer according to the disclosure.

FIG. 4 illustrates a flow diagram of an example of a method of manufacture of keyboard membranes including a thermally fused spacer according to the disclosure. As illustrated at 494, the method 490 can include providing a first circuit including a first conductive trace and a first key contact of the keyboard membrane, where the first conductive trace is coupled to the key contact.

Similarly, the method 490 can include providing a second circuit including a second conductive trace and a second key contact of the keyboard membrane, where the second conductive trace is coupled to the second key contact, as illustrated at 495. Providing can include manufacture of and/or otherwise procuring the first circuit and the second circuit.

As illustrated at 496, the method 490 can include disposing a first thermoplastic film on a first face of a layer of thermoplastic material. The method 490 can include disposing a second thermoplastic film on a second face of the layer of thermoplastic material to form a spacer, as illustrated at 497. Notably and in contrast to other approaches, the method 490 does not include printing adhesive and/or use of solvent based adhesives to form the keyboard membrane. That is, keyboard membranes as described herein are formed without and therefore do not include various materials (e.g., UV curable inks and/or printed adhesives) employed by other approaches.

As illustrated at 498, the method 490 can include causing the first thermoplastic film and the second thermoplastic film to a reach a temperature above respective glass transition temperatures of the first thermoplastic film and the second thermoplastic film to fuse the spacer to the first circuit and the second circuit when the spacer is adjacent to the first circuit and the second circuit to form the keyboard membrane. Causing refers to directly causing the first thermoplastic film and the second thermoplastic film to a reach temperature above respective glass transition temperatures of the first thermoplastic film and the second thermoplastic film or performing an action with an expectation of the first thermoplastic film and the second thermoplastic film to a reach temperature above respective glass transition temperatures of the first thermoplastic film and the second thermoplastic film.

Causing the first thermoplastic film and the second thermoplastic film to reach the temperature above the respective glass transition temperatures can include heating and/or applying pressure to the first thermoplastic film and the second thermoplastic film. In some examples, causing the first thermoplastic film and the second thermoplastic film to reach the temperature above the respective glass transition temperatures comprises heating the first thermoplastic film and the second thermoplastic film to a temperature between about 40° C. to about 65° C. Causing can, in some examples, include applying at least 448 kilopascals of pressure to the first thermoplastic film and the second thermoplastic film.

For example, the first thermoplastic film and the second thermoplastic film can be fused or otherwise suitable coupled to a first circuit and/or a second circuit when the first thermoplastic film and the second thermoplastic film included in the spacer are positioned between the first and second circuits and brought above respective glass transition temperatures of the first thermoplastic film and the second thermoplastic film to form a keyboard membrane, as described herein. For instance, in some examples, spacer including the first thermoplastic film and the second thermoplastic film can be positioned between the first circuit and the second circuit and subsequently brought above respective glass transition temperatures the first thermoplastic film and the second thermoplastic film and/or above respective melting points of the first thermoplastic film and the second thermoplastic film such that the first thermoplastic film and the second thermoplastic film are allowed to cool to a temperature lower than the respective glass transition temperatures and/or the respective melting points to form keyboard membrane where the spacer is fused to the second circuit and the first circuit.

In some examples, the method 490 can include bringing the thermoplastic material above its glass transition temperature comprises heating the thermoplastic material to a temperature between about 40° C. to about 65° C. and applying at least 448 kilopascals of pressure to the thermoplastic material. That is, all temperatures included in the range between about 40° C. to about 65° C. are included. For instance, the thermoplastic material can be heated to about 40° C., 50° C., ° C., 60° C., or about 65° C., among other possibilities to promote thermally fused spacers as described herein.

It will be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" or 'directly fused' to another element it is understood that are no intervening elements (adhesives, screws, other elements) etc. and/or no other intervening elements other than a particular intervening element specified (e.g., a thermoplastic film).

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples (e.g., having different thickness) may be utilized and that process, electrical, and/or structural changes may be made without departing from the scope of the disclosure.

The figures herein follow a numbering convention in which the first digit corresponds to the drawing figure number and the remaining digits identify an element or component in the drawing. For example, reference numeral 105 may refer to element 105 in FIG. 1 and an analogous element may be identified by reference numeral 205 in FIG. 2.

Elements shown in the various figures herein can be added, exchanged, and/or eliminated so as to provide a number of additional examples of the disclosure. In addition, the proportion and the relative scale of the elements provided in the figures are intended to illustrate the examples of the disclosure, and should not be taken in a limiting sense. Further, as used herein, "a number of" an element and/or feature can refer to one or more of such elements and/or features. Further still, while some elements are designated as a "top" view those of ordinary skill in the art will recognize that such orientations may correspond to a "bottom" view in some applications in order to practice the examples of this disclosure.

What is claimed:

1. A keyboard membrane, comprising:

a first circuit including a first conductive trace and a first key contact of the keyboard membrane, wherein the first conductive trace is coupled to the first key contact;

a second circuit including a second conductive trace and a second key contact of the keyboard membrane, wherein the second conductive trace is coupled to the second key contact, and wherein the second key contact is to couple to the first key contact; and a spacer formed of a layer of thermoplastic material, a first thermoplastic film, and a second thermoplastic film, wherein the spacer is fused via the first thermoplastic film to the first circuit and via the second thermoplastic film to the second circuit.

2. The keyboard membrane of claim 1, wherein the spacer overlays an entire length of at least one of the first conductive trace and the second conductive trace.

3. The keyboard membrane of claim 1, wherein the spacer includes a continuous layer overlaying at least a portion of the first conductive trace and at least a portion of the second conductive trace, and wherein the spacer includes cutouts in communication with at least one vent.

4. The keyboard membrane of claim 1, wherein the spacer is fused to the first circuit and the second circuit to seal the first conductive trace and the second conductive trace.

5. The keyboard membrane of claim 1, wherein the layer of thermoplastic material is from 10 microns to 1000 microns thick.

6. The keyboard membrane of claim 1, comprising an opening to permit the first key contact to contact the second key contact.

7. A keyboard membrane, comprising:

a first circuit including a first face, a first conductive trace, and a first key contact;

a spacer formed of a layer of thermoplastic material, a first thermoplastic film, and a second thermoplastic film, wherein the spacer is directly fused via the first thermoplastic film to the first face of the first circuit to seal the first conductive trace; and a second circuit including a second face, a second conductive trace, and a second key contact, wherein the spacer is directly fused via the second thermoplastic film to the second face of the second circuit to seal the second conductive trace.

8. The keyboard membrane of claim 7, comprising at least a portion of an opening extending from the first key contact to the second key contact and through the spacer.

9. The keyboard membrane of claim 7, comprising a vent included in the second circuit, wherein the vent extends through an entire thickness of the second circuit.

10. The keyboard membrane of claim 7, wherein the thermoplastic material comprises polyethylene terephthalate.

11. The keyboard membrane of claim 7, wherein keyboard membrane is free of printed adhesive between the first circuit and the second circuit.

12. A method of manufacture of a keyboard membrane, comprising:

providing a first circuit including a first conductive trace and a first key contact of the keyboard membrane, wherein the first conductive trace is coupled to the key contact;

providing a second circuit including a second conductive trace and a second key contact of the keyboard membrane, wherein the second conductive trace is coupled to the second key contact;

disposing a first thermoplastic film on a first face of a layer of thermoplastic material;

disposing a second thermoplastic film on a second face of the layer of thermoplastic material to form a spacer; and causing the first thermoplastic film and the second thermoplastic film to a reach a temperature above respective glass transition temperatures of the first thermoplastic film and the second thermoplastic film to fuse the spacer to the first circuit and the second circuit when the spacer is adjacent to the first circuit and the second circuit to form the keyboard membrane.

13. The method of claim 12, wherein causing the first thermoplastic film and the second thermoplastic film to reach the temperature above the respective glass transition temperatures comprises heating the first thermoplastic film and the second thermoplastic film to a temperature between about 40° C. to about 65° C.

14. The method of claim 13, wherein causing the first thermoplastic film and the second thermoplastic film to reach the temperature above the respective glass transition temperatures comprises applying at least 448 kilopascals of pressure to the first thermoplastic film and the second thermoplastic film.

15. The method of claim 12, wherein the method of manufacture of the keyboard membrane does not employ a printing adhesive, an ultraviolet curable ink, nor a solvent based adhesive.

* * * * *